US008025608B2

(12) United States Patent
Popescu

(10) Patent No.: US 8,025,608 B2
(45) Date of Patent: Sep. 27, 2011

(54) CONTINUOUS ROPE PULLING EXERCISE APPARATUS

(75) Inventor: Marius Popescu, Livermore, CA (US)

(73) Assignee: Marius Popescu, Livermore, CA (US)

( * ) Notice: Subject to any disclaimer, the term of this patent is extended or adjusted under 35 U.S.C. 154(b) by 38 days.

(21) Appl. No.: 12/191,194

(22) Filed: Aug. 13, 2008

(65) Prior Publication Data

US 2010/0041520 A1 Feb. 18, 2010

(51) Int. Cl.
*A63B 9/00* (2006.01)
*A63B 22/02* (2006.01)
*A63B 27/00* (2006.01)

(52) U.S. Cl. ..... 482/37; 482/49; 482/51; 482/92; 482/111; 482/114

(58) Field of Classification Search ..... 482/23, 482/34, 37, 44, 49, 51, 115, 118–120, 111, 482/114; 182/239
See application file for complete search history.

(56) References Cited

U.S. PATENT DOCUMENTS

| | | | | | |
|---|---|---|---|---|---|
| 290,961 | A * | 12/1883 | Bixby | 182/19 |
| 641,519 | A * | 1/1900 | Kerns | 482/119 |
| 709,127 | A * | 9/1902 | Wachter | 182/241 |
| 861,707 | A * | 7/1907 | Cain | 182/42 |
| 1,040,354 | A * | 10/1912 | Klocko | 182/144 |
| 1,593,704 | A * | 7/1926 | Morris | 188/187 |
| 2,122,315 | A * | 6/1938 | Fosty et al. | 182/237 |
| 3,599,974 | A * | 8/1971 | Price | 482/118 |
| 4,979,737 | A * | 12/1990 | Kock | 482/80 |
| 5,076,574 | A * | 12/1991 | Johnson, Jr. | 482/37 |
| 5,328,422 | A * | 7/1994 | Nichols | 482/52 |
| 5,496,234 | A * | 3/1996 | Sussich | 482/37 |
| 7,018,323 | B1 * | 3/2006 | Reynolds et al. | 482/37 |
| 7,060,003 | B1 * | 6/2006 | Reynolds et al. | 482/37 |
| 7,303,506 | B1 * | 12/2007 | Reynolds et al. | 482/37 |
| 7,387,593 | B2 * | 6/2008 | Ryan et al. | 482/37 |
| 7,811,204 | B2 * | 10/2010 | Popescu | 482/37 |
| 2007/0275829 | A1 * | 11/2007 | Popescu | 482/37 |
| 2008/0234109 | A1 * | 9/2008 | Taylor | 482/51 |
| 2009/0137370 | A1 * | 5/2009 | Kushnir | 482/120 |

FOREIGN PATENT DOCUMENTS

| | | | |
|---|---|---|---|
| GB | 2341806 | A * | 3/2000 |
| JP | 52023423 | A * | 2/1977 |
| JP | 52024670 | A * | 2/1977 |
| SU | 1430040 | A * | 10/1988 |
| SU | 1477432 | A * | 5/1989 |
| WO | WO 9322003 | A1 * | 11/1993 |
| WO | WO 03076021 | A1 * | 9/2003 |
| WO | WO 2010019330 | A2 * | 2/2010 |

* cited by examiner

*Primary Examiner* — Loan Thanh
*Assistant Examiner* — Victor K Hwang

(57) ABSTRACT

A unique rope-pulling exercise apparatus that includes a support structure, a continuous rope, and a means for applying resistance to the force applied on the rope by the user, as the rope is pulled in either direction.

22 Claims, 9 Drawing Sheets

CONTINUOUS ROPE PULLING EXERCISE APPARATUS

BACKGROUND OF THE INVENTION

Rope climbing is an effective form of exercise because it makes it possible for the user to workout on all upper body muscles in one exercise. This not only saves time but it makes for a better balance in strength for upper body as opposed to the case where an individual over emphasizes the exercising of a single muscle to the point where other muscles around it are more prone to injury since they are not balanced in strength. The invention allows the user to maintain their arm and back muscles under dynamic tension. Placing one's body under dynamic tension of this type improves one's muscle tone, blood circulation, respiration, and general mental and physical fitness.

Rope climbing may be practiced as an exercise in and of itself or as part of training for mountain or rock climbing. Also, Prior exercise machines of this general type have tended to be fairly large and complicated pieces of machinery that take up a large amount of floor space and are relatively expensive to make.

It is therefore an object of the invention to provide a rope pulling exercise apparatus of this general type that is relatively compact and that requires a relatively small amount of floor space.

Another object of the invention is to provide a rope pulling exercise apparatus that is safe and that permits natural body movement during the exercise.

A further object of the invention is to provide a rope pulling exercise apparatus that is adjustable to accommodate users whose strengths vary over a relatively wide range.

Another object of the invention is to provide a rope pulling exercise apparatus that is composed of relatively few components that are easy and inexpensive to fabricate.

Another object of this invention is to allow the user to pull the rope in different directions, reverse pull (upwards), and in a different embodiment, at different angles (diagonal), or horizontal.

Other objects will, in part, be obvious and will, in part, appear hereinafter. The invention accordingly comprises the features of construction, combination of elements and arrangement of parts that will be exemplified in the following detailed description.

SUMMARY OF THE INVENTION

The rope pulling exercise apparatus comprises an upstanding frame that supports a system of pulleys around which the rope is trained to form an endless loop. One or more of these pulleys are rope gripping pulley/wheels connected to the braking mechanism via pulleys, gears with belts and sprockets with chains. One or more pulleys can be adjusted in position to either control the tension or slack in the rope, and in a different embodiment to allow for the rope to have significant slack so that the user can pull the rope in other directions other than vertical (up or down) such as at an angle or horizontally. In the embodiment where the user could pull the rope at different angles and even horizontally, significant slack in the rope needs to be managed so as not get twisted and tangled. The apparatus would have a series of rollers positioned to surround and guide the rope and keep it from getting caught or twisted due to the excessive slack. In this embodiment, the top pulley of the apparatus can be repositioned and locked in place at different locations up and down on the boom, to create the slack needed for different rope pulling directions. The user can pull the rope hand over hand or both hands simultaneously. The top pulley would be part of a carrousel assembly where rollers of the carrousel would be sliding on rail-like elements of the boom. In a different embodiment, the carrousel can slide on shafts as part of the boom. Instead of rollers, thrust bearings could be used. Typically there would be a means to lock the carrousel in specific locations on the boom to provide the different angle on the rope. In certain embodiments, the locking of the carrousel is done by spring loaded pins which snap in recesses on the boom. The carrousel can be locked in place by other means such as tightening a knob which would cause the surfaces from the carrousel and boom to be under high friction. In another embodiment, the boom has two rails side by side and the carrousel riding between the two rails. The two rails of the boom can be replaced by other configurations where only one rail is used and the carrousel rides up and down the rail, and can be locked in place along the boom. The number of rail members can vary where three or four rails would be used and the carrousel would be guided along these rails and locked in designated locations.

The user adjusts the rope resistance by changing the position of a handle or a dial. The handle is connected to the brake mechanism via cam and a cable. In certain embodiments, somewhere along this cable a spring would be used to magnify the stretch in the cable. The cam can have a uniform arc, but it can also be variable to form what is also known as a nautilus. As the user changes settings for rope resistance, the cable is stretched over the cam which, in turn, sets a threshold for when the governor will activate the brake system. In other embodiments, the cable can be replaced by a stiff element such a drive link bar. This stiff element would provide linkage and actuation between the handle which the user activates and the braking system. In a different embodiment, the linkage between the user handle and the brake system can be similar to what a typical bicycle uses for brake cable where the cable is inserted in a sleeve and connected between the handle and the brake system. In another embodiment, the mechanical way of setting resistance (cam and cable) can be replaced by an electric signal sent via a switch and wire to a servo in the brake system. The user interface can still be a handle or it can de a dial, keypad or touch screen.

A seat is typically part of the apparatus and it can either be removable or fixed. In the preferred embodiment the seat is locked on the frame of the unit via hook like features which would lock into cutouts in the frame, or wrap around stem-like protrusions. This configuration allows the user to sit or kneel while exercising. The user may also stand while using the machine for full body, lower body, or upper body workouts. The user can stand beside the seat (left or right), behind, straddle it or remove it all together.

In another embodiment, the apparatus will have a unit floor restraining platform on which the user can stand or kneel to pin the unit on to the floor while pulling the rope upwards. The platform can include a flexible mat which runs over the front end extension of the unit. The user would stand on this mat using body weight to pin the mat on top of the front extension of the unit. The mat can be removable, or it can be a permanent rigid platform attached to the front end of the apparatus.

In certain embodiments, the pulley at the top of the apparatus will have a bracket wrapped around it to keep the rope from falling off and to protect the hand of a user from accidentally getting trapped in the top pulley when the rope is pulled in reverse. In other embodiments, the rope can be restrained on the top pulley by having other pulley/s trap the rope from the opposite direction. There can also be one or more wheels positioned at the top to keep the rope from coming off of the top pulley.

The rope pulling exercise apparatus typically has a brake system, and in certain embodiments, a dynamic drag control system along with the brake system. The means for dynamic drag/brake control in the preferred embodiment is a governor mechanism, but an electric motor and an electronic control board with sensor/s in the system can also provide the dynamic drag control. In a different embodiment it would be possible to harness the energy created by the user when pulling on the rope, to generate the power needed to power up the electronic control boards and the motor mentioned above. A battery may be used to "wake up" the system and then the power generator mentioned above can take over the power needs of the rope pulling exercise apparatus.

The brake system, with a dynamic drag control system and the rope, create a closed loop system. As the user pulls the rope, the rope spins the dynamic drag control system which is coupled to the brake system. The brake system controls the speed and resistance the user feels during use. In certain embodiments, the drag mechanism can be excluded and just use the brake system, along with the rope, to form a closed loop system. An electronic display is used to relate performance data back to the user, such as duration of use, speed, distance and caloric use. The display can also show more complex images such as virtual environments where characters are shown climbing ropes, buildings, mountains, trees, etc. This virtual display is meant to entice the user to work out longer and harder, or just for pure entertainment purpose. The user can see achieved milestones on the virtual display such as scores or floor levels climbed on a building. A display can also be used for user instructions. The rope has its two ends connected in such a way that it can be easily disconnected and reconnected without significant disassembly of the apparatus. Each end of the rope may include an end cap. The end caps can be joined together with links of chain which are pinned in the cap with a cross through pin or cross through screw. In other embodiments, instead of chain links to connect the end caps, other means can be used such as cables, straps, and strands of fabric, leather, or other thinner pieces of rope. The end caps are made of hard material such as plastics, epoxy, resin or metals and are preferably glued onto the rope with epoxy. The rope end is embedded in epoxy and then twisted inside the end cap. The end cap has an internal thread feature cut into the inside wall of the cap which pulls the rope inside as the two are twisted together. In other embodiments, the end cap can be molded or casted onto the end of the rope. Since the rope material is typically polymer based, its end can be melted and casted in a shape that serves the purpose of an end cap which allows for a mechanical joining of the two rope ends. In another embodiment, the end cap is a metal component which is crimped on the end of the rope and then dipped into a soft rubber like material to create a softer layer between the metal end cap and the user's hand.

When assembled on the unit, the rope is pinched against a "rope gripping wheel/pulley via one or more guiding wheels/pulleys. Pinching the rope onto the rope gripping wheel/pulley increases the grip between the rope and the rope gripping wheel/pulley. The rope gripping pulley/wheel is what connects the rope to the braking mechanism mentioned above. The rope can be replaced by a necklace like-rope which is made by having a series of balls molded on a thinner rope or cable. On the cable there would be ferrules crimped on so each molded ball would anchor on one or more ferrules. This would ensure that each molded ball would stay locked in place onto the cable. The individual balls can also be threaded on the wire cable or on the rope in such a way that each ball will lock in place when pulled on. The wire or rope can wind in and out of the ball so that the bends and turns lock the wire or cable and the ball together.

Polyurethane is the preferred material for the rope gripping wheel/pulley because of its superior abrasion resistance. At the proper durometer value, polyurethane will exhibit great gripping property on the rope. Other materials can be used besides polyurethane, such as rubber, latex, neoprene, santoprene, hypalon, EPDM, buna-N, SBR, vinyl rubber, butyl rubber, natural gum rubber, viton rubber, latex-free TPE. However, many of these materials would have to be vulcanized to make them durable.

As the user pulls on the rope, the rope pulling exercise apparatus provides resistance to the pulling force via one of the following mechanisms, or combination of any of the following: a governor for dynamic drag adjustment and one of these brake mechanisms: a magnetic brake mechanism (eddy current mechanism), a viscous brake, fluid mill brake, wind mill brake, electric motor brake or a drum and pad/strap friction brake.

A governor is a mechanical subassembly which in the preferred embodiment, converts inertia (rotational) forces into linear (axial) forces. In the preferred embodiment it can be used to dictate when the brake engages and how hard it engages. One of the main benefits of a governor is that it allows for dynamic drag adjustment in a rope pulling exercise apparatus where the drag level is a function of speed. The faster the governor spins, the higher the drag. As the speed is reduced, the drag reduces as well. In certain embodiments of this invention, the motion and forces of the governor are amplified with the help of gears, pulleys, belts, and/or sprockets with a roller chain in order to achieve sufficient inertial forces to properly apply brake to the system.

In the preferred embodiment, the governor's inertia forces are transferred as axial forces to the brake system via a "shaft and notch" feature. The main shaft spins with the governor body. At one end, the shaft has an axial bearing, and at the opposite end it has a notch which is meant to interlock with the main body of the governor. The notch self aligns with a through pin in the body of the governor.

The governor mechanism characteristics could enhance the user experience for other fitness products such as spinner bikes, recumbent bikes, elliptical trainers and steppers. Typical mechanisms used for drag control in the above mentioned products have one common drawback, as speed goes down, drag goes up, which is a much undesired phenomenon for the user since typically users tend to slow down when fatigued. Having a brake mechanism that makes it even harder at lower speeds is counter productive to the needs of the user. Furthermore, in these mechanisms the highest drag occurs when the speed is at zero which means the user has to exert excessive energy and power to get the momentum going. With a governor the opposite happens. It takes little force to get the mechanism going and the drag will go up as the user increases speed. Also, as the user slows down due to fatigue, the resistance lowers. This inverted resistance curve reduces strain and injury on joints of legs or arms, and greatly improves the overall experience for the user. These benefits will make it more likely that the user will adopt using the apparatus on a regular basis.

In a different embodiment, a magnetic resistance brake system can be used. This type of mechanism uses a magnetic phenomenon known as eddy currents to generate drag and to control motion. This comprises one or more magnets which are placed within a certain controlled distance or angle from a conductive component such a copper, aluminum or steel disk/flywheel. Either by spinning the disk, or in the alternative, spinning the magnets and keeping the disk steady, this creates the magnetic phenomenon known as eddy currents which create drag when going through the conductive disk/flywheel. The drag is used as the braking force for rope. The eddy current intensity can be adjusted by controlling the gap between the magnet and the conductive component. Eddy currents can also be adjusted by rotating (changing the angle) the magnetic field away from the conductive component, or by inserting a non-conductive element to partially or totally block the magnetic field from reaching the conductive component, thus controlling the amount of drag. The drag can also be controlled by changing the amount of magnet surface area which overlaps the conductive material of the disk/flywheel.

The magnetic field (eddy currents) can be amplified by using a "U" shaped magnetic metal strap and one magnet fixed to each of the two legs of the "U" shaped conductive strap. The two magnets would be oriented so they repulse each other. Part of the spinning disk/flywheel would then be exposed to the magnetic field. As the disk spins through the magnetic field, drag is generated. From left to right the order sequence would be as follows to create the magnetic field eddy currents:

left leg of the "U" strap,
first magnet fixed to the left leg of the "U" strap,
spinning disk/flywheel,
second magnet fixed to the right leg of "U" strap, right leg of the conductive strap. The brake system would be connected to the rope gripping pulley via belts and gears or chain and sprockets.

As an improvement to an exercise apparatus which uses the above magnetic resistance brake system, in a different embodiment a governor mechanism could be added to dynamically control the amount of drag the system generates. The forces generated by the governor would control the amount of magnet overlapping the disk/flywheel, or in a different embodiment it would control the position of a non-conductive material in between the magnet/s and flywheel to block or expose the flywheel to the magnetic field generated by the magnets. In either embodiment, as more magnetic field passes through the conductive flywheel, the drag on the disk/flywheel increases. To some degree, the faster the flywheel spins the higher the amount of drag. But most of the drag is created by having more magnetic field going through the flywheel. A thicker flywheel will increase the drag, as well as moving the magnets from the center of the flywheel, thus creating a longer moment arm. The longer the moment arm, the higher the drag forces.

In another embodiment, a viscous brake mechanism can be used as the breaking system. A viscous brake mechanism uses three main elements to create drag: 1) an outer shell/housing, which houses; 2) a sealed rotor; and 3) a viscous material such as silicone, oil or hydraulic fluid which is placed between the rotor and the housing. When the rotor spins in the housing, the layer of viscous material between them is being sheared thus creating drag. Controlling the viscosity of the fluid or the amount of the fluid in the mechanism allows for drag control. Controlling the fluid amount usually requires a storage/exchange reservoir and one or more valves to control the amount of fluid used at anytime. The brake system would be connected to the rope gripping pulley via belts and gears or chain and sprockets.

As mentioned above, drag can be controlled by controlling the viscosity of the fluid. This can be done by changing the temperature of the viscous fluid. The lower the temperature of the fluid, the higher the viscosity, the higher the temperature of the fluid the lower the viscosity and as mentioned earlier, as viscosity increases so does the drag and vice versa.

Another way to control drag in the viscous brake system is by having adjustable features on the rotor such as blades or fins. Changing the angle of the blade/s similar to the way blades on airplane propeller change angle, will affect the drag within the viscous mechanism.

Another way to control drag within a viscous brake is to keep the viscous fluid constant and change the amount of rotor surface exposed to the fluid. The rotor could be formed in different shapes such as cylindrical or conical.

The basic properties of a viscous brake system allow for dynamic drag adjustment. As the rotor spins faster, the drag goes up, but there is a limit to the drag range as a function of rotor speed. The drag range can be further increased by dynamically adjusting the total surface area of the rotor that comes in contact with the viscous fluid at different speeds. Adding a governor to a viscous brake will allow for more dynamic drag adjustment by having the governor push more length of the rotor into the viscous fluid. As the rotor and governor spin together the inertia forces of the governor can push more of the rotor in the fluid thus increasing surface contact between fluid and rotor which translates into an increase in drag.

In another embodiment, a drum and pad or drum and strap mechanism can be used as a brake mechanism. The drum's ability to spin as the rope is pulled is controlled by the friction from a pad or a strap as it is pushed against the surface of the drum. The actuation of the pad can be magnified by having a spring attached to this strap and stretching the strap by pulling on the spring. The spring acts as a magnifier for the tension of the strap. The brake system would be connected to the rope gripping pulley via belts and gears or chain and sprockets.

Just as with a magnet and flywheel mechanism or with a viscous brake, in another embodiment a governor can be used to dynamically control the brake amount for a drum and pad, or drum and strap mechanism. The governor would dynamically control the pressure between a drum and pad, or drum and strap. In another embodiment, the governor would dynamically control the amount of contact surface area between the spinning flywheel and brake pad or strap. In either embodiment, the speed of the rope will directly impact the actuation of the governor, which in turn will change the amount of drag the brake system will generate.

In another embodiment, a fluid mill can be the brake system. A fluid mill is made of three main components: a container which can be sealed, fluid such as water, and a rotor with fins which would spin through the fluid. The brake system would be connected to the rope gripping pulley via belts and gears or chain and sprockets. In this brake system, the size of fluid ports in the container can be adjusted to change the amount of fluid moving through the enclosed container. This dictates the resistance the blades will encounter as they spin.

In another embodiment, a governor can be used to dynamically control the drag generated by the fluid mill by using the governor to control the size of the fluid ports in the mill container.

In another embodiment, a wind mill can be used as a break mechanism. This mechanism uses a rotor with blades and air resistance to generate drag. Pulling on the rope would spin the rotor with blades. Controlling the angle of the blades to control the amount of blade surface exposed to direct air flow would create brake adjustment. Further, more as with most of the brake mechanisms described herein, to some extent drag is a function of speed, so the faster the rope is moving, the faster the rotor will spin, causing increased drag.

In another embodiment, a governor can be used to dynamically control the angle of the blades on the rotor. The governor can also control when the rotor will spin at a specific speed.

With all of the above brake systems, the main function of the governor is to allow for dynamic adjustment and to invert the drag curve so at low RPM, the drag is low and as the RPM increases, the drag increases.

In different embodiments of the rope pulling exercise apparatus, the seat can either be fixed to the frame or it can be removed via a quick release feature to allow the user to workout without the seat.

In other embodiments of this invention, the governor and brake system can be replaced by an electric motor which is mechanically linked to the rope via sprockets and chains, and/or gears, and/or pulleys with belts. By controlling the current that drives the motor one can control the speed with which the motor spins, thus controlling the speed of the rope.

DETAILED DESCRIPTION OF THE DRAWINGS

Figure 1:
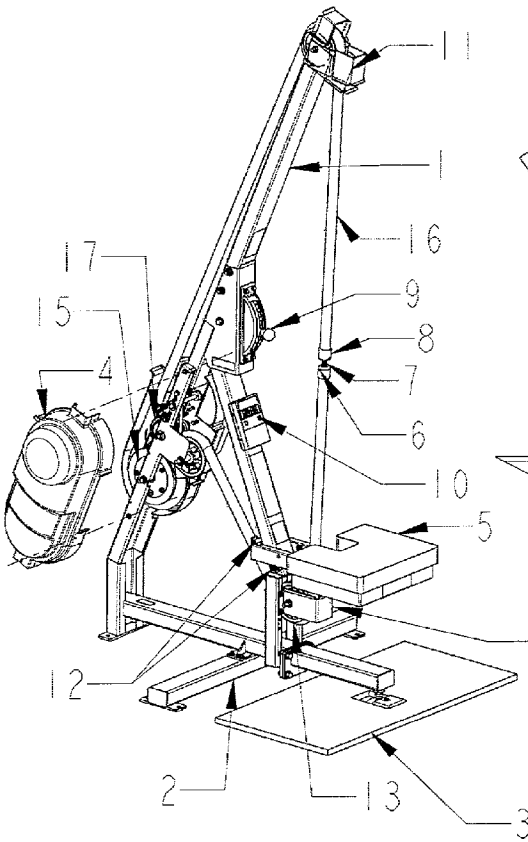
FIG. 1 is a perspective view of the embodiment of the invention where the top pulley is fixed at the top of the boom.

Referring to FIG. 1 there is shown an exercise device comprising a skeleton 1, which comprises the main support structure of the invention. Due to the significant forces the invention will be subjected to during use, a preferred embodiment of the skeleton 1 will be made from strong materials, such as metal or other materials capable of withstanding significant forces. Detachable side leg 2 is shown attached horizontally to the skeleton 1 to provide stability to the overall apparatus. The platform 3 is used to hold down the unit when used without the seat, while the user pulls the rope in an upwards direction. The user will stand on the platform 3, which is connected to the front end of the unit, thus allowing the user to pull up on the rope without lifting the unit off of the ground. Rollers 13 are used to control the direction/path of the rope 16. A cover 4 houses several components, including components that control rope speed. The seat 5 allows the user to sit or kneel during use. Rope ends 8, along with chain link 7 and screws 6 allow the rope ends to join and form a closed loop. Shift handle 9 allows the user to interface the apparatus to set the desired rope 16 speed. The rope restraining bracket 11 on top of skeleton 1 will prevent the rope 16 from falling off the apparatus, especially when the rope is pulled upwards. This bracket 11 will also prevent the user's finger from reaching the top pulley when pulling the rope upwards. The bracket 11 will pivot up and down to absorb some of the initial contact with the user's fingers. The user can sit or kneel on the seat 5 or can remove the seat all together for standing workouts. The seat 5 has a quick release hook on feature 12 to allow for tool less removal of the seat. The bracket 14 can be relocated up and down to adjust tension in the rope 16. The rope 16 is shown wrapping around the rope gripping roller 15. The gear 17 is connected to the rope gripping roller 15 via a chain or belt. An electronic display 10 is shown to relate performance data back to the user, such as duration of use, speed, distance and caloric use. The display can also show more complex images such as virtual environments where characters are shown climbing ropes, buildings, mountains, trees, etc.

Figure 2:
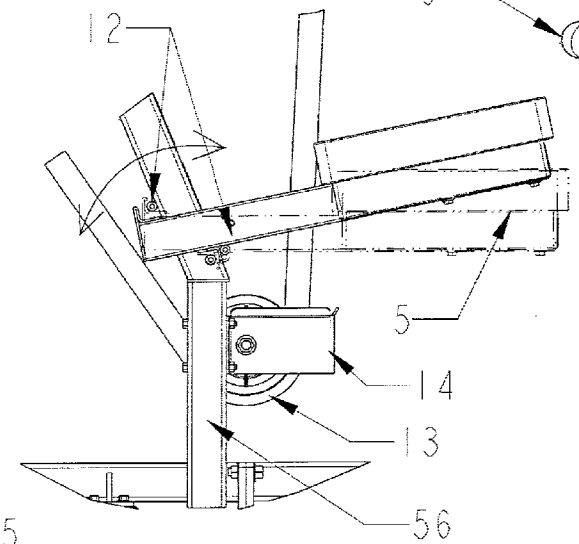
FIG. 2 is a side view of the quick release feature for the seat.

FIG. 2 shows a close up view of a portion of the invention. In this figure the preferred embodiment of the quick release seat is shown. Seat component 5 is shown in dotted line for "in use" position" and in solid line as the seat would be lifted up and pivoted off of frame hook features 12. Bracket 14 provides rope path restraint and it also allows for rope tension. To adjust the tension of the rope 16, bracket 14 can be relocated to different hole pattern on the frame posts 56. By moving the bracket 14 to a lower hole pattern on the frame posts 56, tension will increase in the rope 16. By moving the bracket to a higher hole pattern on the frame posts 56, tension will decrease in the rope 16. The rope pulley 13 is attached to the bracket 14.

Figure 3:
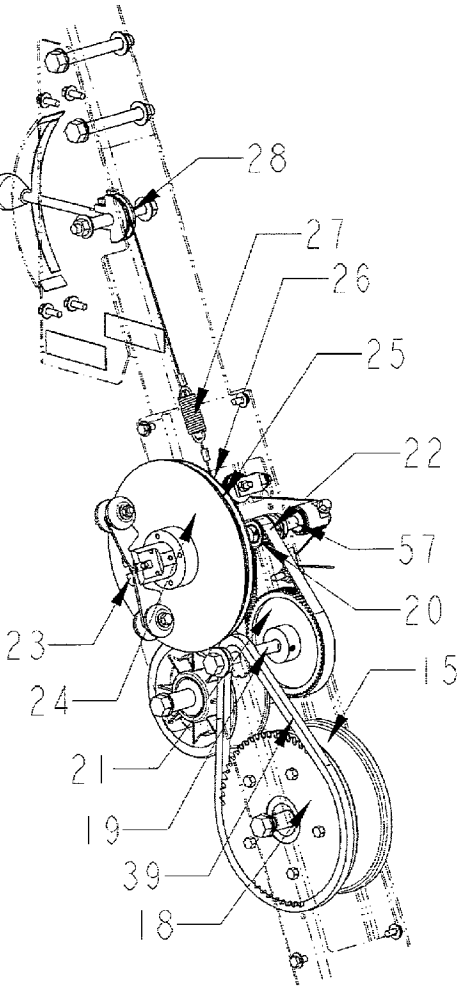
FIG. 3 is a perspective view of a portion of an embodiment of the invention viewed from the side opposite to that shown in FIG. 1.

FIG. 3 shows the sprocket 18 mounted onto the rope gripping roller 15 and transfers the energy generated by the user during exercise to the axis 19, then onto gear 20 via gear 21 and belt 22. This force is then transferred to the governor 23 that, as it spins, forces the brake disks 24 and 26 to compress the buffer pad 25. The engaged brake system 24, 25, 26 will cause the movement of the rope 16 to slow.

High torque loads are generated by the user during exercise. To avoid rope slippage at the rope-gripping roller 15, a sprocket 18 and roller chain 39 transfer motion to an intermediate axis 19. From this intermediate axis 19, the motion is further transferred to the axis of the governor 57 via a plurality of gears 20 and rubber belt 22. In a preferred embodiment, gears and rubber belts can be used to reduce noise that might be associated with the use of a sprocket and roller chain spinning at high RPM. As the gear ratio increases the speed for gear 20, the torque loads should decrease by the same ratio for gear 20.

The governor 23 is part of a mechanical subassembly in the apparatus that converts inertia (rotational) forces into linear (axial) forces and provides dynamic brake adjustment. A purpose of the governor 23 is to regulate the speed of the rope during use. The governor 23, along with the related parts, including but not limited to the braking system 24, 25, 26, spring 27 and gears and sprockets 18, 21, 20 allow the user to adjust the rope's 16 range of speeds and resistance to pulling forces. The motion of the governor 23 is amplified by the sprocket 18, 40 (see FIG. 10) and gears 20, 21 and is amplified to convert the given inertial forces into sufficient linear force to properly brake the system during use. As the user pulls on the rope, this provides rotational force to the large sprocket 18. The small gear assembly 20 is in functional link with sprocket 18 via a plurality of sprockets, roller chain 39 (see FIG. 10), gears 21, 20 and belt 22. As the large sprocket 18 rotates during use, the small gear 20 is rotated at a significantly faster rate than the large sprocket 18. The small gear 20 is attached to the governor 23, which spins at the same rate as the small gear 20.

In a different embodiment, the top rope pulley as part of a carrousel, can move up and down the boom 52 and lock in place at specific locations to allow significant slack in the rope 16 for diagonal and horizontal rope orientation.

Figure 4:
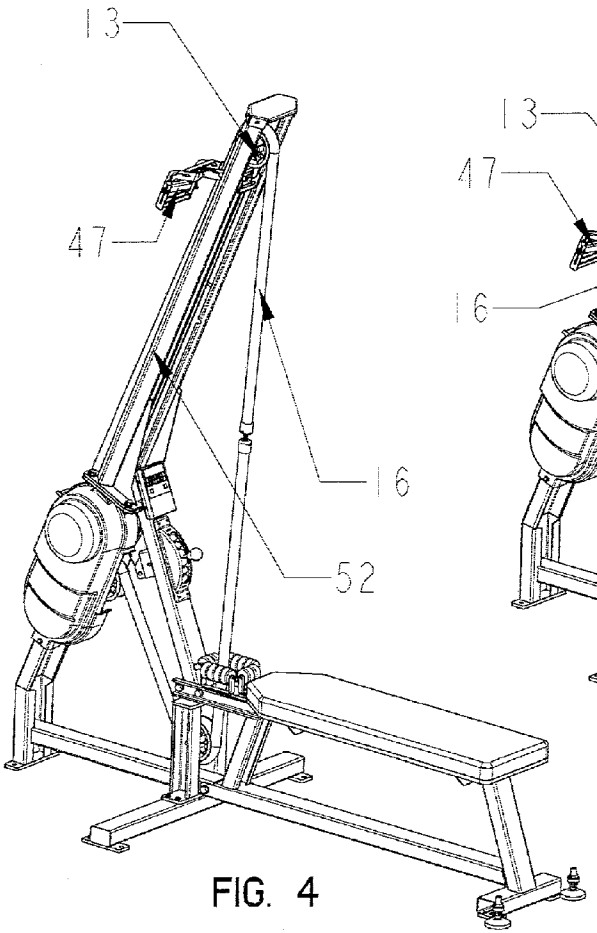
FIG. 4 is a perspective view of an embodiment where the rope pulley, shown at the top position, can slide up and down the boom.

FIG. 4 shows the carousel, with its pulley 13, located at the upper end of the boom, which puts the rope 16 in a position to be vertically oriented. The handle 47, shown in FIGS. 4, 5, and 6, allow the user to move the carousel assembly along the boom 52, and lock it into place where the user desires.

Figure 5:
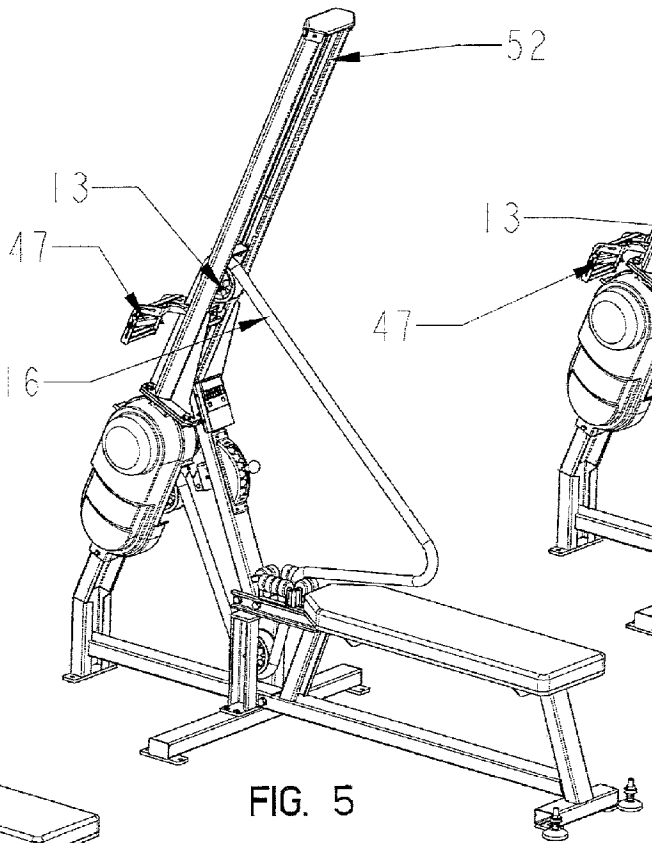
FIG. 5 is a perspective view of an embodiment where the rope pulley, shown at the mid position for diagonal rope pull direction, can slide up and down the boom.

FIG. 5 shows the carousel, with its pulley 13, approximately midway down the boom 52, which allows the user to pull the rope 16 in a diagonal downward direction.

Figure 6:
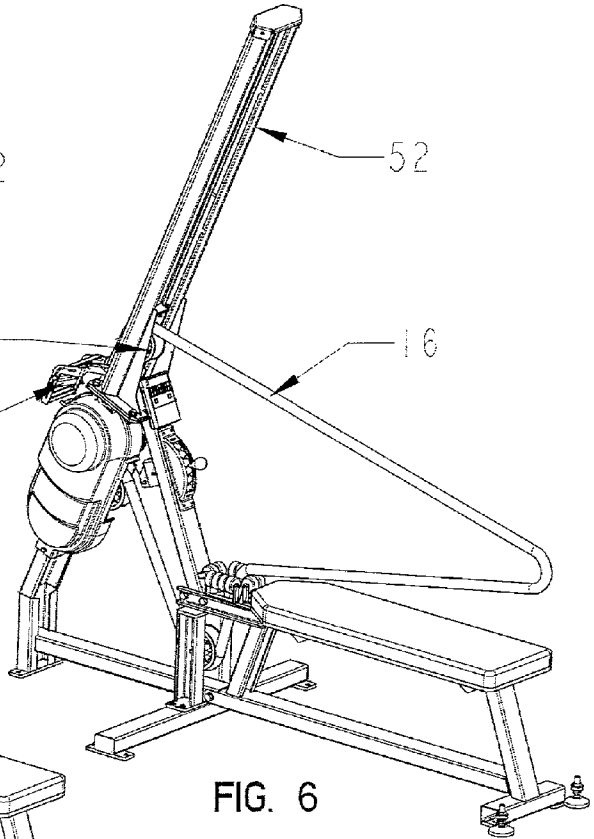
FIG. 6 is a perspective view of an embodiment where the rope pulley, shown at the lowest position for horizontal rope pull direction, can slide up and down the boom.

FIG. 6 shows the carousel assembly, with its pulley 13, in its lower position, which allows the user to pull the rope 16 horizontally.

Figure 7:
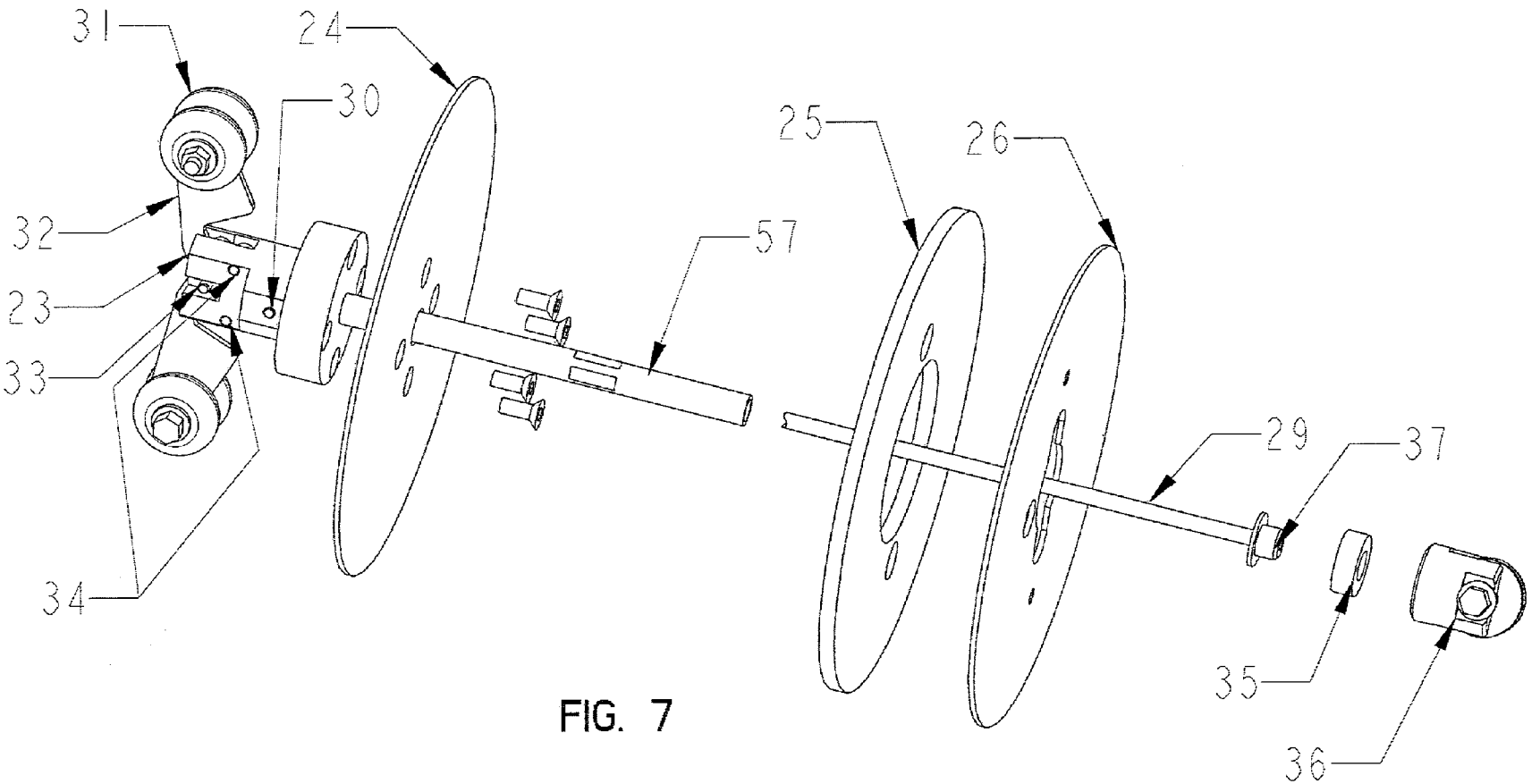
FIG. 7 is a perspective exploded view of the governor.

FIG. 7 shows an exploded view of the governor and brake system. As the governor 23 spins during use, the governor weights 31 rotate about the axis 33. Due to centrifugal forces, the governor weights 31 begin to rise off the plane of the brake disk 24. In one embodiment, the governor weights 31 are attached and hinged to the governor 23 via mounting brackets 32, and as they rise from the plane of the brake disk 24 during use, the other end of the mounting brackets 32 press on pins 34 that are attached to the interior of the governor 23. When a certain level of pressure from the above-described action has been placed on the governor pins 34, the governor presses into the mobile brake disk 24. As this occurs, friction is created between the mobile brake disk 24, the buffer 25, and the fixed brake disk 26. This friction tends to slow the mobile brake disk 24, which in turn tends to slow the governor 23, the small gear 20 (FIG. 11), the large sprocket 18 (FIG. 10), and finally the rope 16 (FIG. 1). The pin 30 connects the governor 23 to the governor tube 57. Pin 30 also engages shaft 29 via end "V" notch thus allowing the shaft 29 to spin with tube 57 and the governor 23. End cap 37 is an intermediate component which connects shaft 29 to axial bearing 35 and hub 36. Axial bearing 35 makes it possible for hub 36 not to have to spin with the rest of the governor.

Figure 8:
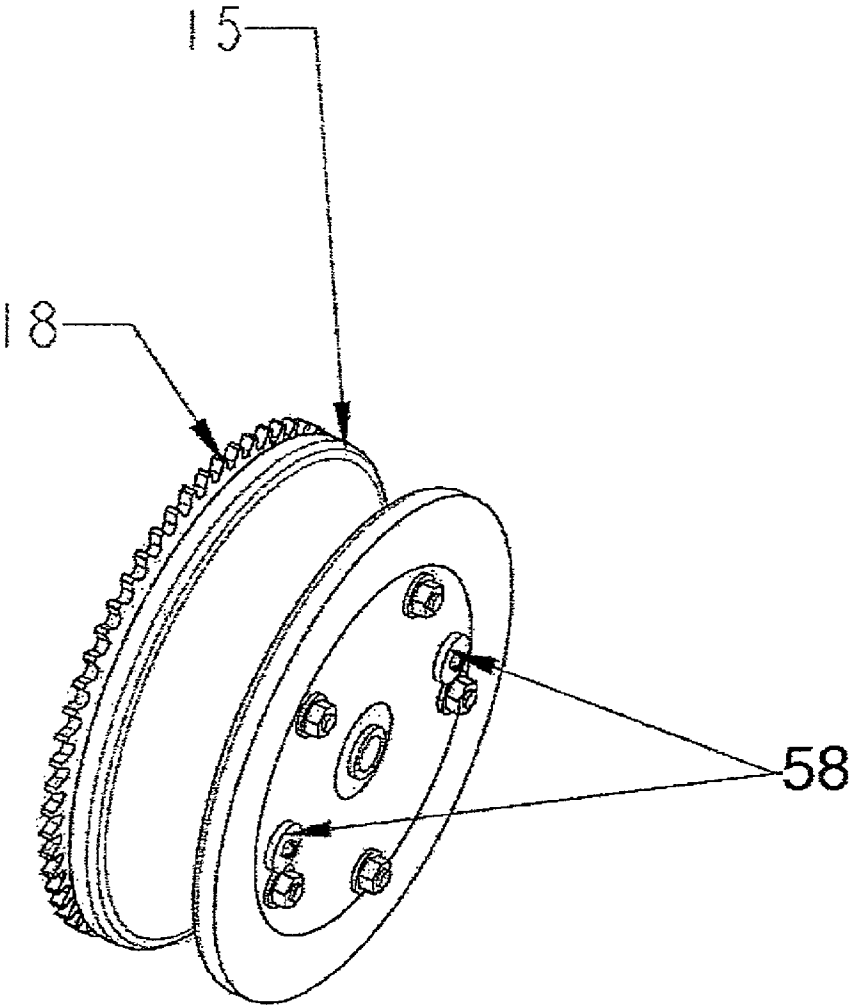
FIG. 8 is a perspective view of the rope gripping roller and the sprocket.

FIG. 8 shows how the rope gripping roller 15 connects to the sprocket 18. Magnets 58 are positioned so they pass by a sensor 41 (FIG. 11) which is used to send tracking data to the unit display 10 (FIG. 1).

Figure 9:
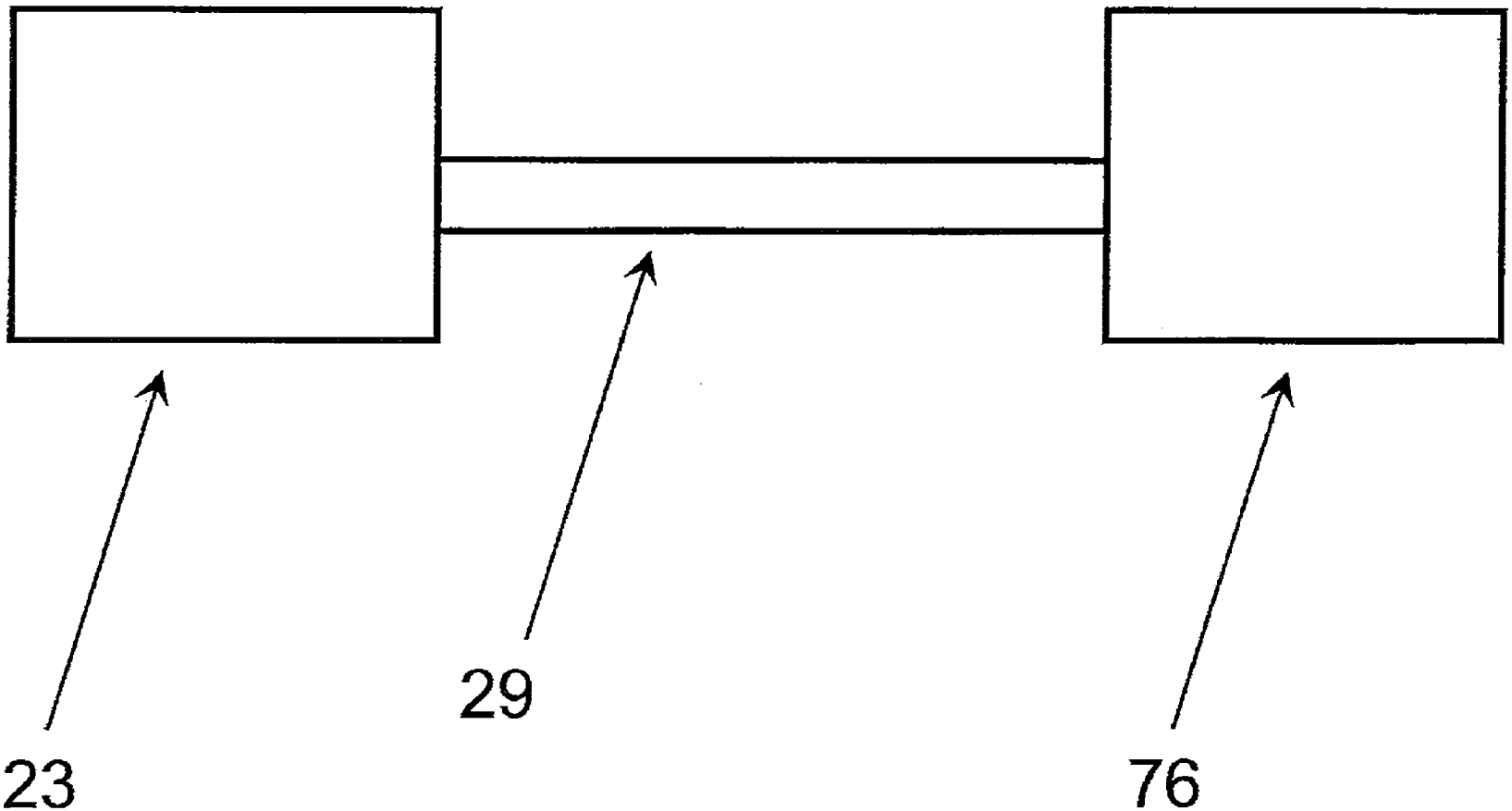
FIG. 9 is a schematic of an embodiment of the governor and brake mechanism.

FIG. 9 illustrates the embodiment where a governor 23 is used in conjunction with a brake mechanism 76. As the governor 23 spins, the inertial forces from the governor weights 31 push the shaft 29 which activates the brake mechanism 76. The governor 23 is connected to the rope 16 (as shown in FIG. 1) so as the user varies the speed of the rope 16 (FIG. 1), the amount of braking varies.

Figure 11:
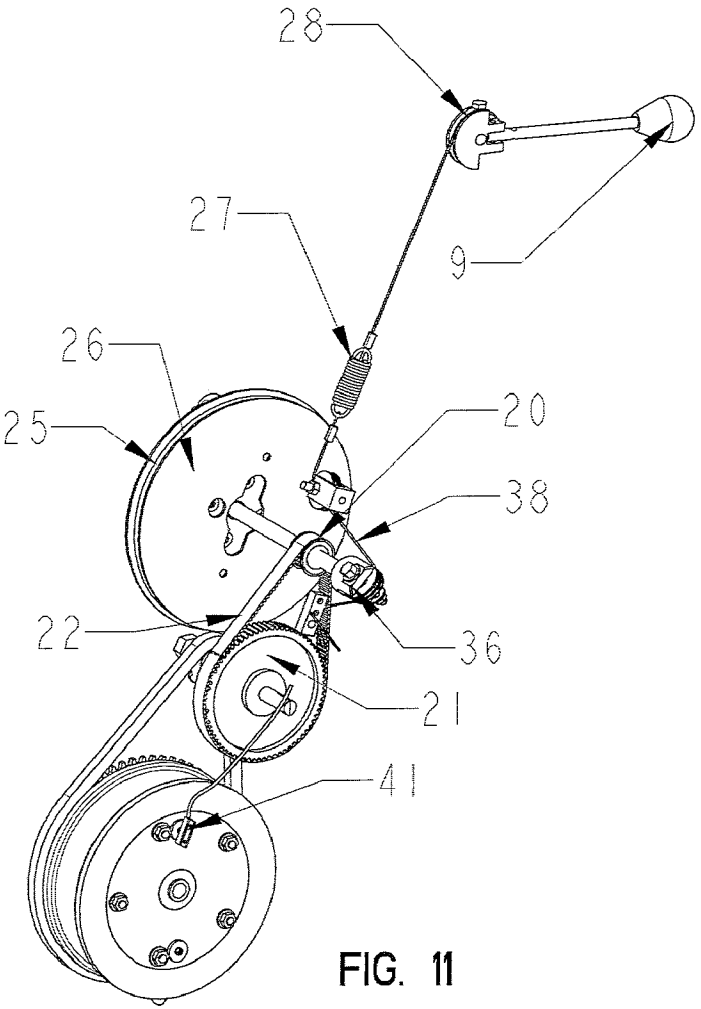
FIG. 11 is a perspective view of the gears and sprockets connected to the governor and brake mechanism along with resistance shifter handle viewed from the side opposite to that shown in FIG. 10.
Figure 10:
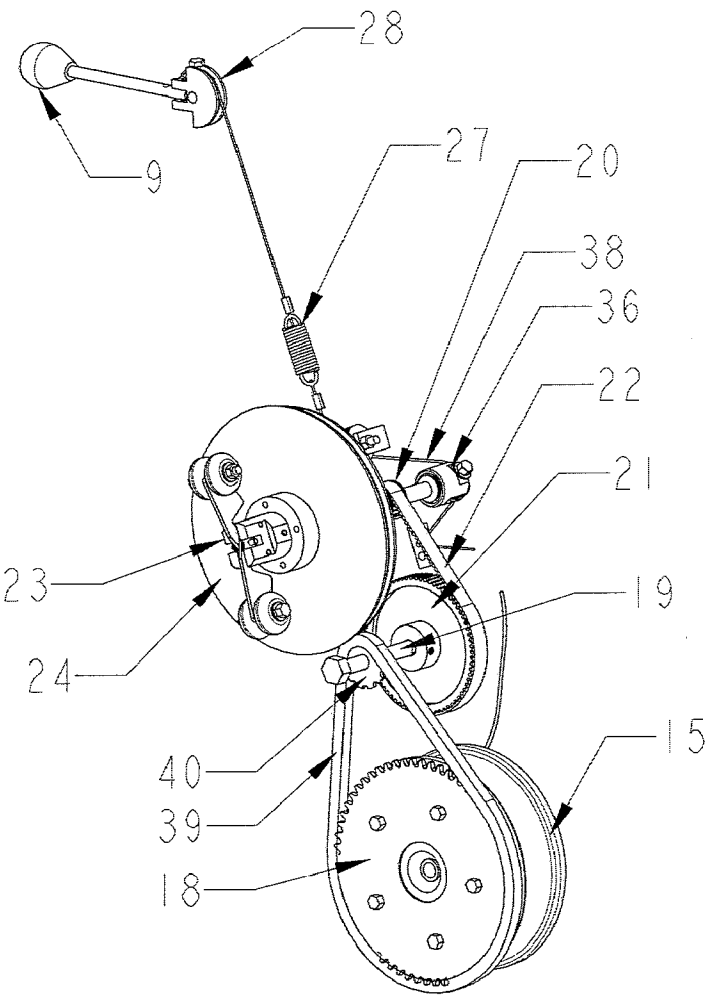
FIG. 10 is a perspective view of the gears and sprockets connected to the governor and brake mechanism along with resistance shifter handle.

FIGS. 10 and 11 show the entire governor and brake system along with the system which allows the user to control the brake settings. The rope 16 (FIG. 1) wraps around the rope gripping pulley 15 which is connected to the rest of the brake system via a sprocket 18. Roller chain 39 transmits the motion from rope 16 to mid axis 19 via sprocket 40. The motion then is transmitted to the governor 23 via gears 21 and 20 (FIG. 11). As the governor 23 spins, brake disks 24 and 26 apply pressure onto the buffer pad 25. Cable 38 is pre-tensioned by the user via rotating handle 9. As the handle 9 is rotated, the cable 38 wraps around a cam 28. The spring 27 amplifies the stretch in cable 38. At a given speed of the governor 23, weights 31 (FIG. 7) will overcome the force of the spring 27 and force the brake disks 24 and 26 to apply pressure to the buffer pad 25.

Figure 13:
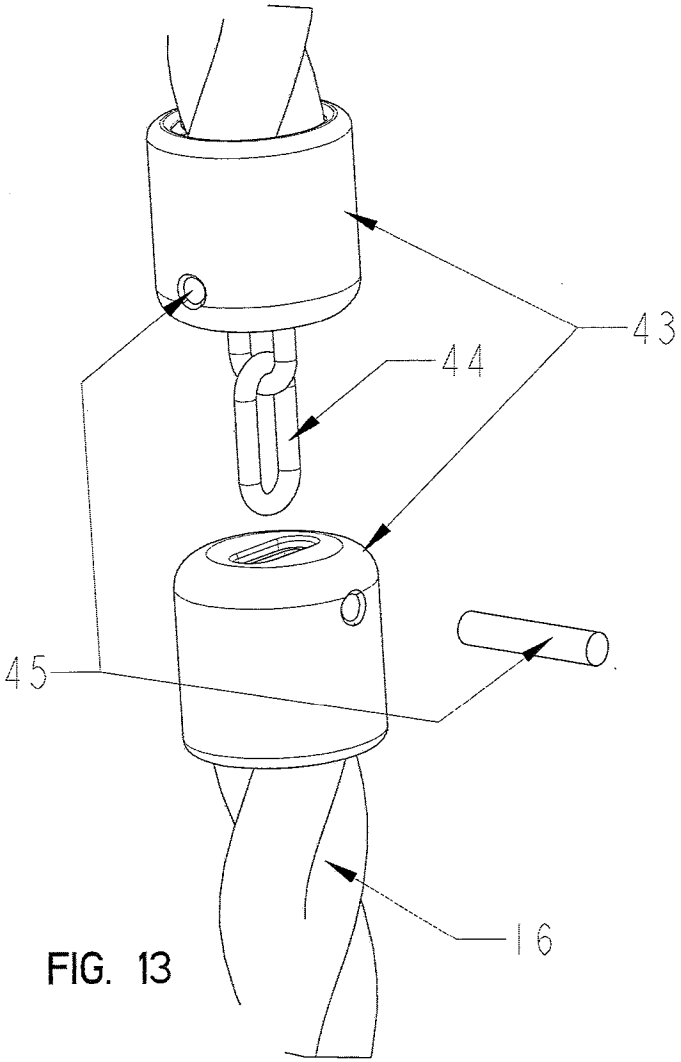
FIG. 13 is an exploded perspective view of the rope ends with end caps, chain links and through pinning screw.
Figure 12:
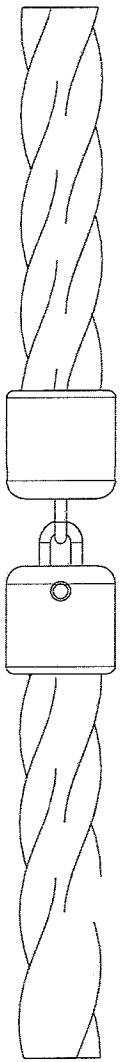
FIG. 12 is a perspective view of the rope ends with end caps, chain links and through pinning screw.

FIGS. 12 and 13 show the rope ends and how they get connected. End cap 43 can be secured on the rope with epoxy. The chain link 44 is secured inside the end cap 43 with a pin or as in the preferred embodiment with a bolt 45 which goes through the diameter of the end cap. Each end cap 43 has an internal thread cut in the walls which is used to pull the end of the rope 16 up inside. This is an important feature since the end of the rope would be hard to properly push in, due to the fact that rope strands are hard to keep together and push in properly, where as the thread inside the cap pulls the rope up as the end cap 43 is twisted on the end of the rope 16.

Figures 14, 15, 16, 17:
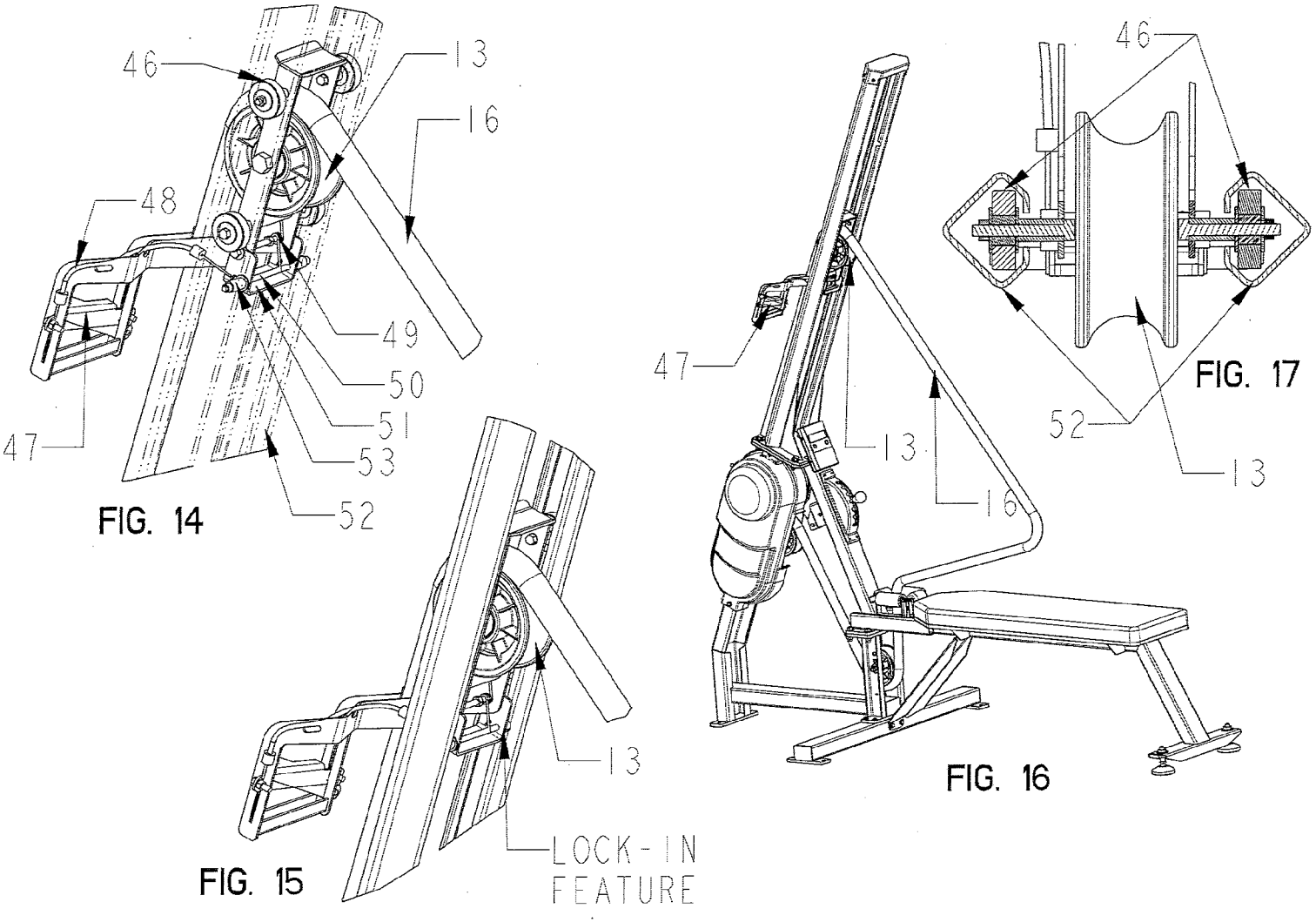
FIG. 14 is a perspective view of the embodiment in which the top rope pulley is part of a carrousel assembly which allows it to move up and down the boom.
FIG. 15 a perspective view of the embodiment in which the top rope pulley is part of a carrousel assembly emphasizing the notch in the boom rail which serves as a lock-in feature for the carrousel.
FIG. 16 is a perspective view of the embodiment in which the top rope pulley is part of a carrousel assembly which allows it to move up and down the boom where the overall product is illustrated.
FIG. 17 is a cross-section view of the carrousel mounted in the booms. The emphasis is on the boom rails and the rollers of the carrousel. It shows how the geometry of the boom rails makes it possible for the rollers of the carrousel to self-align.

FIGS. 14 and 15 show the carousel assembly on the booms of an embodiment where the rope can be re-positioned to allow for diagonal or horizontal rope pulling. In FIG. 14 the booms 52 are shown in transparent mode to better illustrate the rest of the components between the two booms. Handle 47 is what releases the carousel to slide up and down the boom 52. When squeezing down on the handle 47, a cable 48 is activated which in turn pulls on the locking bracket 51. Assembled on locking bracket 51 are a shaft 50 and bearings 53. A spring 49 maintains the locking bracket 51 in the locked position. Rollers 46 allow the carousel assembly to move up and down on the boom 52. The rope 16 goes through the two handles of the carousel and over the pulley 13. In FIG. 15, a "lock-in" feature is shown. The entire carousel assembly is held in place on the boom 52 by having bearings 53 snap in the lock-in feature on the boom 52.

FIG. 16 shows the carousel handle 47, pulley 13 and rope 16 in context with the rest of the device.

FIG. 17 shows a cross section of the carousel rollers 46 and the boom rails 52. The rope pulley 13 is positioned between the boom rails 52.

Figures 18, 19:
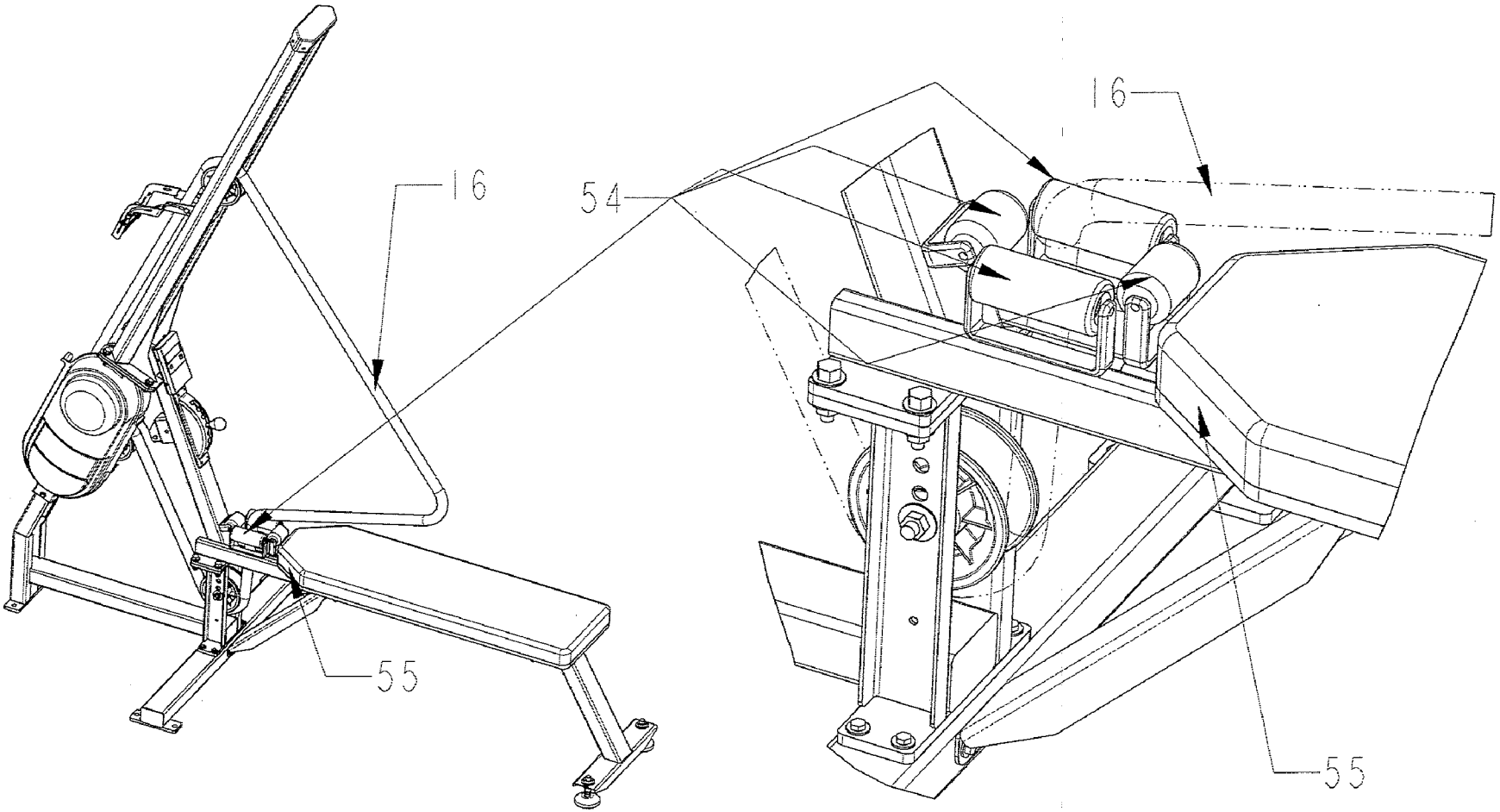
FIG. 18 is a perspective view of the embodiment in which the top rope pulley is part of a carrousel assembly which allows it to move up and down the boom and where the guiding rope rollers are emphasized along with the shape of the front end on the seat.
FIG. 19 is a close-up, perspective view of the embodiment where the guiding rope rollers are emphasized along with the shape of the front end on the seat.

FIGS. 18 and 19 show the front two corners of the bench 55 which are tapered off so that the rope 16 will not get hooked on the front end of the bench 55 as the rope 16 is used in diagonal or horizontal mode. While used in the diagonal or horizontal mode, the rope 16 has excessive slack which could make it possible to get hooked on the front end of the bench 55. Adjacent to the front end of the bench are rope managing rollers 54. In this embodiment the managing rollers 54 are positioned to keep the rope 16 from tangling as it rolls off the bench 55 down into the rest of the unit.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

What is claimed is:

1. An exercise apparatus for permitting a user to exercise by pulling on a continuous rope comprising:

a. a frame, said frame comprising:
   i. main chassis where rope control mechanisms are attached;
   ii. a platform that remains positioned beneath the user during use; and
   iii. a boom member, said boom member forming a lower end and an upper end; and
   iv. a boom pulley located along the boom;

b. a length of rope, wherein said rope forms a loop;

c. a plurality of pulleys, wherein each of said plurality of pulleys, and said boom pulley, are configured to rotate while in contact with said rope during use;

d. a braking mechanism that applies resistance to the rope as the rope is pulled by the user; and e. a governor that controls the braking mechanism during use, said governor comprising:
   i. a governor tube, wherein the governor tube spins during use, and wherein changes in the pulling force applied by the user cause acceleration or deceleration of the spinning governor tube;
   ii. a main hub connected to the governor tube, wherein the main hub spins during use;
   iii. a plurality of mounting brackets, each connected to the governor tube, said mounting brackets comprising an upper end and a lower end;
   iv. one or more weights, wherein each weight is connected to the upper end of the mounting brackets;
   v. wherein the weights are allowed to rotate about an axis, said axis separating the upper end and the lower end of the mounting bracket;
   vi. wherein the weights are subjected to centrifugal force caused by the acceleration or deceleration of the spinning main hub during use;
   vii. wherein acceleration of the main hub causes the weights to rotate the mounting bracket about its axis; and
   viii. wherein the rotation of the mounting bracket about its axis activates the braking mechanism.

2. The exercise apparatus of claim 1, further comprising a carriage member, said carriage member comprising a pulley.

3. The exercise apparatus of claim 2, wherein said carriage member is capable of being adjustably locatable along the length of the boom member.

4. The exercise apparatus of claim 1, wherein said braking mechanism comprises:

a. a viscous brake mechanism;
b. a wind mill brake mechanism;
c. a magnetic brake mechanism;
d. a fluid mill brake mechanism;
e. a drum and pad/s brake mechanism; or
f. a drum and strap brake mechanism.

5. The exercise apparatus of claim 1, wherein the braking mechanism is amplified through the use one or more of the following:

a. sprockets with chains;
b. gears;
c. timing belts;
d. pulleys;
e. belts; or
f. sheaves.

6. The exercise apparatus of claim 1, comprising:

a. wherein the governor is located within a drum, said drum comprising an inside surface and an outside surface, wherein the drum and the governor are allowed to spin at the same speed during use; and b. a belt, wherein said belt:
   i. tightens through the action of the governor during use, and
   ii. creates friction with the outside surface of the drum when the belt is tightened through the action of the governor during use.

7. The exercise apparatus of claim 1, wherein:

a. the governor is located on a first disk, said first disk and governor capable of spinning at the same speed during use; and b. a second disk is fixed in a position, wherein the second disk and first disk are pressed together by the governor creating friction; and c. a buffer pad is located between the first and second disks, and rigidly mounted to the first disk.

8. The exercise apparatus of claim 1, wherein the governor is adjustable through the use of a shift handle capable of exerting a force on a tension rod, wherein the tension rod is located within the governor.

9. The exercise apparatus of claim 8, further comprising a spring connected to the tension rod, wherein the spring is capable of exerting a force on the tension rod.

10. The exercise apparatus of claim 1, further comprising a plurality of rollers, said rollers positioned around the rope to manage the rope during use.

11. The exercise apparatus of claim 1, further comprising a rope tensioning bracket that is capable of adjusting the tension in the rope.

12. The exercise apparatus of claim 11, further comprising a roller functionally connected to the rope tensioning bracket, wherein the tension in the rope is capable of adjustment through manipulating the location of the rope tensioning bracket.

13. The exercise apparatus of claim 1, wherein the apparatus is motorless.

14. The exercise apparatus of claim 1, further comprising a plurality of rope rollers capable of guiding the rope, where at least one of the rollers further comprises a rope-gripping roller.

15. The exercise apparatus of claim 1, further comprising one or more of the following:

e. a rope-gripping roller that is attached to a plurality of gears;
f. a rope-gripping roller that is attached to a plurality of pulleys;
g. a rope-gripping roller that is attached to a plurality of sprockets; and
h. a rope-gripping roller that is attached to a sprocket, that is then linked to a governor and a brake mechanism by a plurality of gears and belts.

16. The exercise apparatus of claim 1, wherein the length of rope comprises two ends capable of linking together to form an endless loop, and further comprising chain links capable of attaching together at the junction of the two ends of the rope.

17. The exercise apparatus of claim 1, wherein the length of rope comprises two ends capable of linking together to form an endless loop, and where each end is fused together.

18. The exercise apparatus of claim 1, further comprising an electronic display attached to the frame that displays information to the user.

19. An exercise apparatus for permitting a user to exercise by pulling on a continuous rope comprising:

a. a frame, said frame comprising:
   i. main chassis where rope control mechanisms are attached;
   ii. a platform that remains positioned beneath the user during use; and
   iii. a boom member, said boom member forming a lower end and an upper end; and
   iv. a carriage member, said carriage member being adjustably located along the length of the boom member, to selectively adjust the angle of pulling of a rope by a user between vertical and horizontal, and comprising a pulley, said pulley being located along the boom;

b. a length of rope, wherein said rope is capable of forming a loop;

c. a plurality of pulleys, wherein each of said plurality of pulleys are configured to rotate while in contact with said rope during use; and d. one of the following brake mechanisms:
   i. a wind mill brake mechanism;
   ii. a magnetic brake mechanism;
   iii. a fluid mill brake mechanism;
   iv. a drum and pad/s brake mechanism;
   v. a drum and strap mechanism;
   vi. a viscous brake mechanism; or
   vii. an electric motor.

20. The exercise apparatus of claim 19, wherein the brake mechanism is amplified through the use one or more of the following:

a. sprockets with chains;
b. gears;
c. timing belts;
d. pulleys;
e. belts; and/or
f. sheaves.

21. An exercise apparatus for permitting a user to exercise by pulling on a continuous rope comprising:

a. a frame, said frame comprising:
   i. main chassis where rope control mechanisms are attached;
   ii. a platform that remains positioned beneath the user during use; and
   iii. a boom member, said boom member forming a lower end and an upper end;
   iv. a length of rope, wherein said rope is capable of forming a loop; and
   v. a carriage member, adjustably located along the length of the boom member to selectively adjust the angle of said rope between vertical and horizontal for pulling engagement by the user;

b. a plurality of pulleys, wherein each of said plurality of pulleys are configured to rotate while in contact with said rope during use; and c. one of the following brake mechanisms:
   i. a wind mill brake mechanism;
   ii. a magnetic brake mechanism;
   iii. a fluid mill brake mechanism;
   iv. a drum and pad/s brake mechanism;
   v. a drum and strap mechanism; or
   vi. a viscous brake mechanism.

22. An exercise apparatus for permitting a user to exercise by pulling on a continuous rope comprising:

a. a frame, said frame comprising:
   i. main chassis where rope control mechanisms are attached;
   ii. a platform that remains positioned beneath the user during use; and
   iii. a boom member, said boom member forming a lower end and an upper end; and
   iv. a carriage member, said carriage member being adjustably located along the length of the boom member and comprising a boom pulley, said boom pulley being located along the boom;

b. a length of rope, wherein said rope is capable of forming a loop;

c. a plurality of pulleys, wherein each of said plurality of pulleys, and said boom pulley, are configured to rotate while in contact with said rope during use; and d. a governor that controls a braking mechanism during use, said governor comprising:
   i. a governor tube, wherein the governor tube spins during use, and wherein changes in the pulling force applied by the user cause acceleration or deceleration of the spinning governor tube;
   ii. a main hub connected to the governor tube, wherein the main hub spins during use;
   iii. a plurality of mounting brackets, each connected to the main hub, said mounting brackets comprising an upper end and a lower end;
   iv. one or more weights, wherein each weight is connected to the upper end of the mounting brackets;
   v. wherein the weights are allowed to rotate about an axis, said axis separating the upper end and the lower end of the mounting bracket;
   vi. wherein the weights are subjected to centrifugal force caused by the acceleration or deceleration of the spinning main hub during use;
   vii. wherein acceleration of the main hub causes the weights to rotate the mounting bracket about its axis;
   viii. wherein the rotation of the mounting bracket about its axis activates the braking mechanism; and e. one of the following brake mechanisms:
   i. a wind mill brake mechanism;
   ii. a magnetic brake mechanism;
   iii. a fluid mill brake mechanism;
   iv. a drum and pad/s brake mechanism;
   v. a viscous brake mechanism; or
   vi. a drum and strap mechanism.

* * * * *